United States Patent [19]

Andersson et al.

[11] Patent Number: 4,586,472

[45] Date of Patent: May 6, 1986

[54] ARRANGEMENT IN MOTOR VEHICLES FOR INDICATING ENGINE LOADS

[75] Inventors: Olle Andersson, Gothenburg; Bengt L. Mörner, Hovås, both of Sweden

[73] Assignee: AB Volvo, Göteborg, Sweden

[21] Appl. No.: 668,986

[22] Filed: Nov. 6, 1984

[30] Foreign Application Priority Data

Nov. 9, 1983 [SE] Sweden ..... 8306168

[51] Int. Cl.[4] ..... F02D 9/00

[52] U.S. Cl. ..... 123/401

[58] Field of Search ..... 123/389, 401, 341, 342

[56] References Cited

U.S. PATENT DOCUMENTS

| | | | |
|---|---|---|---|
| 3,623,693 | 11/1971 | Hill | 123/389 |
| 3,926,160 | 12/1975 | Husband | 123/396 |
| 4,077,370 | 3/1978 | Spangenberg | 123/401 |
| 4,270,501 | 6/1981 | Breen et al. | 123/389 |
| 4,337,743 | 7/1982 | Mattson | 123/389 |

FOREIGN PATENT DOCUMENTS

| | | |
|---|---|---|
| 923695 | 4/1963 | United Kingdom . |
| 979519 | 1/1965 | United Kingdom . |
| 1510961 | 5/1978 | United Kingdom . |

*Primary Examiner*—William A. Cuchlinski, Jr.

*Attorney, Agent, or Firm*—Young & Thompson

[57] ABSTRACT

An arrangement in a motor vehicle informing the driver of fuel-economy conditions while driving the vehicle, by creating at the limit at which uneconomic driving commences a pressure point at which further depression of the pedal is resisted. The accelerator pedal is acted upon by a vacuum assembly controlled by a control valve having an auxiliary unit which compares the engine intake pressure with a limit pressure for uneconomic driving and which, when the intake pressure exceeds the limit pressure, switches the control valve to a position in which the vacuum assembly is ventilated to atmosphere, whereupon the assembly is set to an inactive state, and automatically resets the control valve to a normal working position, when the intake pressure lies beneath the limit pressure.

10 Claims, 2 Drawing Figures

ARRANGEMENT IN MOTOR VEHICLES FOR INDICATING ENGINE LOADS

Figure 1:
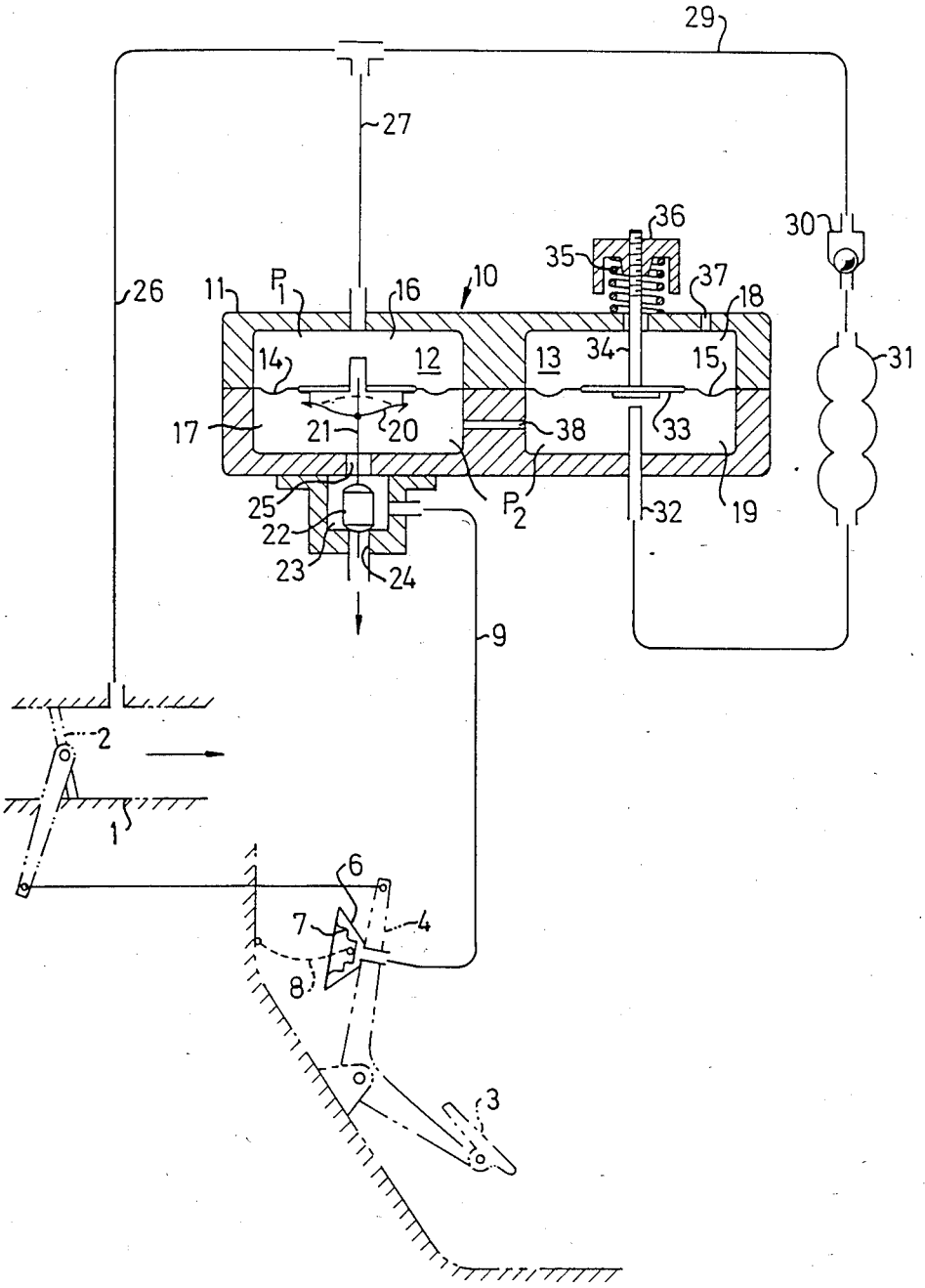

The present invention relates to an arrangement in motor vehicles for indicating engine load conditions, comprising a power-influencing means which is controlled by the intake pressure of the engine and which is co-ordinated with the engine throttle valve in a manner to create a resistance against increases in throttle in dependence upon the intake pressure.

It is generally known that there is a direct relationship between the vacuum in the air intake manifold of an internal combustion engine downstream of the throttle and the engine load, wherewith a high vacuum means a low engine load and a low vacuum means a high engine load. Since fuel consumption is directly related to engine load, and because of rapidly increasing gasoline or petrol prices, motor vehicles are now being fitted with simple vacuum gauges, which visually inform the driver of prevailing vacuum conditions, thereby enabling the vehicle to be driven under the best possible fuel economy conditions. These so-called economy gauges are passive instruments, which the driver must constantly observe and adapt his driving to the reading shown thereon.

An arrangement by means of which a vehicle can be driven under good fuel economy conditions and which does not need to be checked visually by the driver in order to achieve such conditions is also known to the art. In this arrangement the reduction in vacuum pressure is utilised to activate a mechanism which increases resistance to downward movement of the accelerator pedal or gas pedal. Thus, this arrangement is an active arrangement, since it counteracts directly those actions carried out by the driver which would result in poor fuel economy. One disadvantage with this arrangement, however, is that it creates a resistance to downward movement of the accelerator pedal even under those driving conditions when fuel economy is not of primary importance, for example, when accelerating in order to overtake another vehicle, when driving up an incline, or when towing another vehicle.

The object of the invention is to provide an active arrangement of the kind described in the introduction with which the aforesaid disadvantages are avoided.

To this end, in accordance with this invention the power-influencing means is coordinated with means which compares the engine intake pressure with a reference pressure, activates the power-influencing means in a manner to resist increased throttle when the intake pressure reaches the reference pressure, and inactivates the power-influencing means when the reference pressure falls beneath the intake pressure.

The reference pressure is placed at a level corresponding to the borderline at which uneconomic driving commences. Thus, although the driver is informed directly when this limit has been reached, he is not required to overcome additional increasing pressure in the accelerator pedal when accelerating his vehicle to overtake another or when negotiating an incline, for example, and thus exceed the aforesaid limit. Instead the resisting force ceases entirely. In other words, there is obtained with the arrangement according to the invention a 'pressure point', which is re-established automatically when the load falls beneath the level at which uneconomic driving conditions prevail, irrespective of the position of the accelerator pedal.

Figure 2:
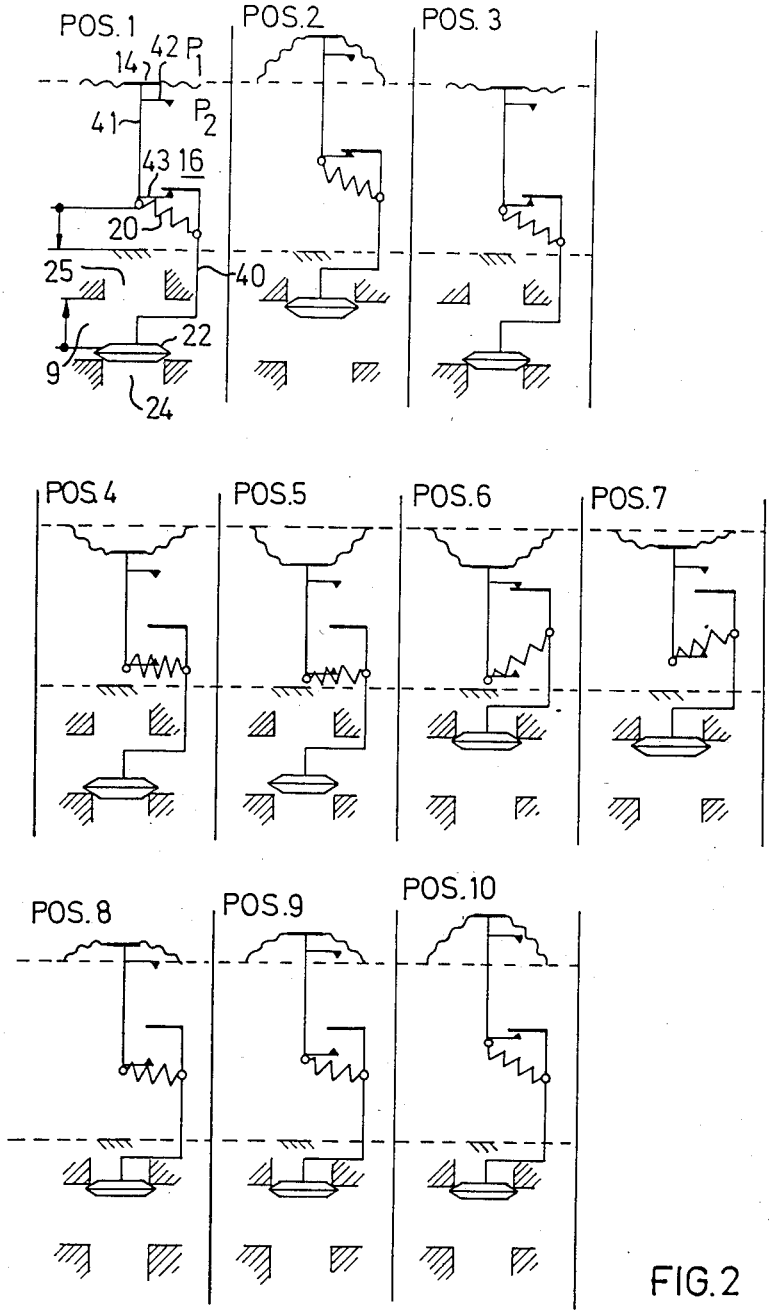

The invention will now be described in more detail with reference to an embodiment thereof illustrated in the accompanying drawings, in which FIG. 1 is a diagram of the arrangement according to the invention, including a sectional view of the control valve and FIG. 2 is a diagram illustrating the operational mode of the arrangement.

In FIG. 1 the reference 1 identifies the intake pipe or manifold of an internal combustion engine, 2 identifies the throttle, and 3 identifies the accelerator pedal by means of which the throttle 2 is controlled in a conventional manner. Mounted on the lever arm 4 of the accelerator pedal 3 is a vacuum assembly 6, which comprises a bellows 7 which has connected centrally thereof a chain 8, which is anchored to the floor of the vehicle. The interior of the vacuum assembly 6 is connected via a line 9 to a control valve 10, which will be described hereinafter. The vacuum assembly 6 can be placed under vacuum or ventilated to atmosphere through the control valve 10. When a vacuum prevails in the vacuum assembly 6, the assembly will exert a counterpressure to downward movement of the accelerator pedal, subsequent to the accelerator pedal having been depressed through the distance required to take up the slack in the chain 8, this slack being shown in FIG. 1. The chain thus forms a free-movement mechanism between the accelerator pedal and the vacuum assembly, the purpose of this mechanism being to eliminate the effect of the vacuum assembly 6 on the accelerator pedal when pulling away from a stationary position and when driving at low speed.

The control valve 10 comprises a housing 11 which defines two cavities 12 and 13, each of which houses a respective diaphragm 14 and 15. The diaphragm 14 divides the cavity 12 into two chambers 16 and 17, while the diaphragm 15 divides the cavity 13 into two chambers 18 and 19. Mounted on the undersurface of the diaphragm 14 is a bistable cup spring 20, which is shown by full lines in one terminal position and by a broken line in the other terminal position. The spring 20 is connected with a spindle 21 associated with a valve body 22 in a valve chamber 23, into which the line or pipe 9 extending from the vacuum assembly 6 discharges. The valve chamber 23 has arranged therein a bore 24, which discharges to atmosphere, and a bore 25 which opens into the chamber 17. The inner edges of the bores 24, 25 are chamfered and form valve seats for the valve bodies.

Connected to the engine intake pipe 1, downstream of the throttle valve 2, is a vacuum pipe 26 which branches into a pipe 27 communicating with the chamber 16 of the valve housing, and a pipe 29 which communicates with a vacuum tank 31, via a check valve 30, said tank in turn communicating with the chamber 19 via a pipe 32 projecting into said chamber. The upper end of the pipe 32 forms a valve seat for a valve plate 33 securely connected to the diaphragm 15 and mounted on a spindle 34, the upper end of which is provided with a screwthread. A spring 35 is arranged between the valve housing 11 and a knob 36 screwed onto the spindle 34.

By means of the described arrangement, the vacuum tank 31 is 'charged up' to the lowest pressure (the highest vacuum pressure) which can occur in the engine intake pipe. The chamber 18 is ventilated to atmosphere through a bore 37, which means that the valve plate 33 is drawn down by the underpressure in the tank, towards the end of the pipe 32 against the action of spring 35, and thereby seals the pipe end at a given vacuum in the chamber 19, this vacuum depending upon the setting of the knob 36. This pressure is the aforementioned reference pressure or limit pressure and is set to the engine torque limit for uneconomic driving. The chamber 17 communicates with the chamber 19 through a bore 38, so that the reference pressure also prevails in the chamber 17.

FIG. 1 illustrates the position of the various components of the control valve when the engine is stationary. The valve body 22 rests on its lower seat under the force of gravity, and closes the ventilation channel 24. When the reference pressure $P_2$ falls beneath the intake pressure $P_1$, the diaphragm 14 bows downwardly and in a given position, dependent upon the characteristics of the cup spring 20, the spring is snapped-over to its position shown in broken lines, whereupon the valve body is moved to its upper position, in which it seals against the seat of the bore 25. It is assumed here that the vacuum assembly is in its inactive state, as a result of the interior of the assembly being placed in communication with atmosphere through the bore 24 of the control valve.

The functional mode of the arrangement is illustrated schematically in FIG. 2, in which those details corresponding directly to the embodiment of FIG. 1 have been identified with the same references. In FIG. 2 the bistable spring 20 is illustrated schematically in the form of a coil thrust spring, and the spindle in this embodiment comprises two parts 40, 41 which can be moved relative to one another and the path of relative movement of which is determined by two end stops 42,43.

In FIG. 2, pos. 1 illustrates the starting position when the engine is stationary, i.e. corresponds to FIG. 1. When the engine is started, the diaphragm 14 is drawn upwardly by suction, (pos. 2) so that the valve body 22 is moved to its upper position and connects the vacuum assembly 6 with atmosphere. At the same time, the diaphragm 15 is drawn downwardly by suction, so that when reference pressure $P_2$ is reached in the chamber 19, the valve plate 33 associated with the diaphragm 15 is brought into sealing engagement with the pipe 32. Pos. 2 illustrates the position with normal driving beneath the limit for uneconomic driving, in which position the intake pressure $P_1$ is lower than the reference pressure $P_2$. In this position, the vacuum assembly has no influence on pedal movement.

In pos. 3 the engine has been loaded so that the intake pressure $P_1$ has risen to a value equal to the reference pressure $P_2$, i.e. the limit at which uneconomic driving commences has been reached. When the intake pressure $P_1$ reaches the reference pressure $P_2$ the valve body 22 is moved to its lower position. The vacuum assemly 6 is now under vacuum, which means that the driver will sense a 'pressure point' in the pedal when he attempts to depress the pedal further, i.e. it is necessary for the driver to use more force on the accelerator pedal in order to increase speed. He thus feels in the pedal that the limit for uneconomic driving has been reached.

Depression of the pedal beyond this pressure point results in a momentary decrease of the reference pressure $P_2$ to a level beneath the intake pressure $P_1$ (pos. 4) due to a volumetric increase in the vacuum assembly with flip-over of the bistable springs (pos. 5) and movement of the valve body 22 to the upper position (pos. 6). The vacuum assembly 6 now, once again, communicates with atmosphere, so that the resistance against pedal movement ceases.

Continued pedal movement takes place without additional resistance and consequently the arrangement according to the invention informs the driver that he is driving uneconomically solely through the aforesaid pressure point in the pedal movement, indicating when the uneconomic driving limit has been passed.

When the engine load falls, there is gradually reached a new equilibrium state $P_1 = P_2$, which is shown in pos 7. Further decrease in the engine load results in the intake pressure $P_1$ falling to a level beneath the reference pressure $P_2$, with subsequent flip-over (pos. 8) of the bistable spring, switchover (pos. 9) of the valve body, and a new normal driving position (pos. 10).

When the engine load again increases, the aforedescribed sequence of events is repeated. It should be particularly noted that the pressure point is re-established irrespective of pedal movement, and that the position of this pressure point is independent of the position of the pedal. If, when accelerating a vehicle, the pedal is depressed to a given position, resulting in a breakthrough according to the afore-described positions 4–7, and this position is maintained, the state of the arrangement returns to that illustrated in pos. 8–10 when the load falls in conjunction with a constant speed being maintained. Further acceleration to higher speeds means that the pressure point will be passed again.

One important advantage afforded by the arrangement according to the invention in the illustrated and described embodiment is that it is fully mechanical and utilises the underpressure of the engine as a power-generation control and as an automatic over-ride function in both directions (exceeding the limit level and return respectively), which means that it is reliable in operation and can be produced at relatively low costs.

What we claim is:

1. In an engine-load indicating arrangement in motor vehicles, comprising power-influencing means controlled by the engine intake pressure and coordinated with the throttle valve of the engine so as to create a resistance against increase in throttle in dependence upon the intake pressure; the improvement in which the power-influencing means is co-ordinated with means which compares the intake pressure of the engine with a reference pressure previously established therein to activate the power-influencing means in a manner to exert resistance against an increase in the throttle when the intake pressure of the engine reaches said reference pressure and to set the power-influencing means to an inactivate state when said reference pressure falls beneath the intake pressure of the engine.

2. An arrangement according to claim 1, in which said means is arranged to rapidly activate the power-influencing means when the intake pressure reaches said reference pressure, and to rapidly set the power-influencing means in an inactive state when the reference pressure falls beneath the intake pressure, so that resistance to said increase in throttle prevails for only a short moment of time when passing the reference pressure level.

3. An arrangement according to claim 1, in which the power-influencing means is a pressure-medium activated means which is co-ordinated with a control valve having a valve body which can be switched between a first position, in which the pressure-medium activated means is active, and a second position, in which said pressure-medium activated means is inactive, the valve body being so connected, via a bistable rocker, with a moveable wall, on the one side of which the intake pressure prevails and on the other side of which the reference pressure prevails, and in which the rocker switches from its one to its other stable position, so as to switch the valve body from its first to its second position, when the reference pressure falls beneath the intake pressure.

4. An arrangement according to claim 3, in which the power-influencing means is a vacuum assembly; and the control valve when occupying said first position establishes communication between the vacuum assembly and a source of vacuum pressure in which the reference pressure prevails, and in the other position establishes communication between the vacuum assembly and atmosphere.

5. An arrangement according to claim 4, in which the moveable wall is a diaphragm in a vacuum box and divides the interior of the box into two chambers, of which the one chamber is under the intake pressure and the other chamber is under the reference pressure.

6. An arrangement according to claim 5, in which the vacuum box is arranged to co-ordinate with a manually adjustable pressure-setting valve for manually adjusting the reference pressure.

7. An arrangement according to claim 6, in which the pressure-setting valve is connected to a vacuum tank, which communicates with the intake pipe of the engine via a check valve.

8. An arrangement according to claim 1, in which the power-influencing means is connected with the throttle valve of the engine via a free-movement mechanism, which enables a vehicle to be accelerated to a given limit without resistance from the power-influencing means.

9. In an arrangement in motor vehicles for indicating the load on the engine thereof, comprising power-influencing means which is responsive to the engine intake pressure and which is co-ordinated with the throttle valve of the engine to resist downward movement of an accelerator pedal of the motor vehicle in dependence upon the intake pressure of the engine; the improvement in which the power-influencing means is a vacuum assembly which communicates, via a control valve, with a vacuum source, the control valve having a valve body which is connected with an auxiliary element which is controlled by the engine intake pressure and which, at low intake pressure, holds the control valve in a first position to ventilate the vacuum assembly to atmosphere, and which upon increasing engine intake pressure switches the valve to a second position to connect the vacuum assembly with the vacuum source.

10. An arrangement according to claim 9, in which the control valve is arranged to switch from the first to the second position when the intake pressure reaches a given limit level, and to switch from the second to the first position when the intake pressure exceeds said limit level.

* * * * *